US008381841B2

(12) United States Patent
Caneer

(10) Patent No.: US 8,381,841 B2
(45) Date of Patent: Feb. 26, 2013

(54) DEBRIS EVACUATOR FOR CLEANING A MASONRY BORE

(76) Inventor: Hadley H. Caneer, Huntington Beach, CA (US)

( * ) Notice: Subject to any disclaimer, the term of this patent is extended or adjusted under 35 U.S.C. 154(b) by 330 days.

(21) Appl. No.: 12/782,508

(22) Filed: May 18, 2010

(65) Prior Publication Data

US 2011/0284034 A1 Nov. 24, 2011

(51) Int. Cl.
*B08B 5/04* (2006.01)
*A47L 9/10* (2006.01)

(52) U.S. Cl. ..... 175/213; 134/21; 15/347

(58) Field of Classification Search ..... 175/209, 175/213, 218; 134/21; 15/345, 347
See application file for complete search history.

(56) References Cited

U.S. PATENT DOCUMENTS

| | | | | |
|---|---|---|---|---|
| 2,329,330 | A | 9/1943 | Brailey | |
| 3,131,947 | A | 5/1964 | McCarty et al. | |
| 3,655,001 | A | 4/1972 | Hoffman | |
| 3,800,890 | A | 4/1974 | Gyongyosi et al. | |
| 4,036,308 | A | 7/1977 | Dellenberg | |
| 4,921,375 | A * | 5/1990 | Famulari | 408/67 |
| 5,653,561 | A | 8/1997 | May | |
| 2002/0104687 | A1 | 8/2002 | Bongers-Ambrosius et al. | |
| 2003/0000749 | A1 * | 1/2003 | Tessier et al. | 180/65.1 |
| 2007/0243031 | A1 | 10/2007 | Yun | |
| 2010/0000796 | A1 * | 1/2010 | Boeck | 175/170 |

* cited by examiner

*Primary Examiner* — William P Neuder
(74) *Attorney, Agent, or Firm* — Fulwider Patton LLP

(57) ABSTRACT

A cover tube concentric about a pressure tube at the opposite end.

14 Claims, 3 Drawing Sheets

DEBRIS EVACUATOR FOR CLEANING A MASONRY BORE

BACKGROUND

1. Field of the Invention

The present invention relates to construction tools and particularly to device for cleaning debris from a bore built in concrete.

2. Description of the Prior Art

In construction and remodeling the occasion frequently arises for inserting reinforcement and anchoring dowels which typically requires drilling of bores in concrete foundational or structural side walls. Debris must then be cleaned from the bores for insertion of the dowels and a bonding such as epoxy. This typically involves the insertion of a nozzle or the like in the bore and for the application of high pressured air to swirl the dust and debris about the bore and elevate the particles and chunks by the flow stream generated by high pressure air. This then typically involves release of robust plumes of dust and debris to the atmosphere thus resulting in discomfort and health hazards to the workman on site and, as the dust and dirt settles, coated walkways and a generally untidy and dangerous workplace.

In other areas of the art, efforts have been made to vacuum dust from a masonry drill bit as by utilizing a hollow drill bit and connecting a flex hose to a vacuum pump. A device of this type is shown in U.S. Pat. No. 3,131,947 to McCarty. Such devices require relatively expensive customized drill bits and manifolding arrangements and, in any event, can be rather ineffective in their application.

Similar problems have been encountered in procedures involving large diameter earth drills wherein efforts have been made to manifold the drill bit and pressurize down hole, purportedly to drive drillings to the earth's surface. A device of this type is shown U.S. Pat. No. 3,655,001 to Hoffman.

Other efforts have been to control dust from a down hole drill bit and have led to a proposal that manifolding be divided down hole for applying high pressure air to drive dust and debris from the hole. Devices of this type are shown in U.S. Pat. No. 3,800,890 to Gyongyosi et al.

Other work has been undertaken in the area of hand drills wherein hollow drill bits covering a boot have been proposed. As an example, U.S. Pat. No. 4,036,308 to Dellenberg shows a hollow bit with manifolding for compressed air. U.S. Pat. No. 5,653,561 to May shows a axially collapsible boot for connection on one end with a drill chuck and constructed to coaxial with a drill bit and house swarf from the working bit.

U.S. Patent Application Publication No. US2002/0104687 published Aug. 8, 2002 to Boners-Ambrosius et al. addresses problems with debris from a masonry drill bit for installing dowels but his solution again relied on hollow drill bits and manifolding.

Other efforts to address the debris from drill bit swarfing has led to the proposal of a multi-chamber collection device coupled with a longitudinally compressible tube through which a drill bit might extend. A device of this type is shown in U.S. Patent Application Publication 2007/0243031, published Oct. 18, 2007 to Yun.

Other features and advantages of the invention will become apparent from the following detailed description, taken in conjunction with the accompanying drawings which illustrate, by way of example, the features of the invention.

SUMMARY OF THE INVENTION

The present invention includes a fitting for connection on one end with a vacuum hose and joined with a high pressure line. A longitudinally compressible tube projects from the fixed fitting to assume variable lengths allowing a pressure tube to project from the distal end thereof for delivering high pressure air to a blind masonry bore as vacuum is drawn within the tube to cooperate in removing debris and dust from a masonry bore and the like.

DETAILED DESCRIPTION OF THE PREFERRED EMBODIMENTS

Figure 1:
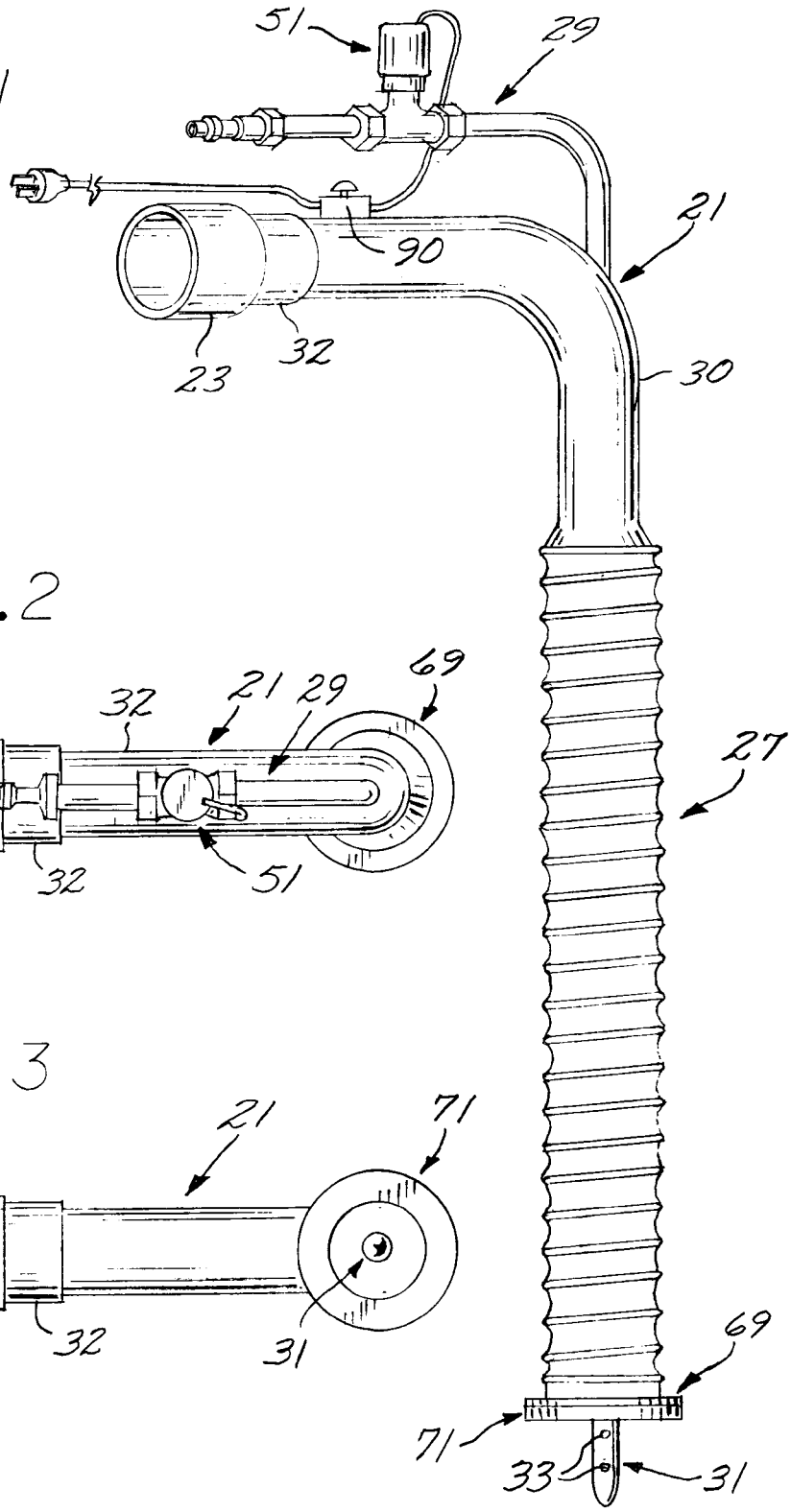
FIG. 1 is a front view of a cleaning device embodying the present invention.
Figure 2:
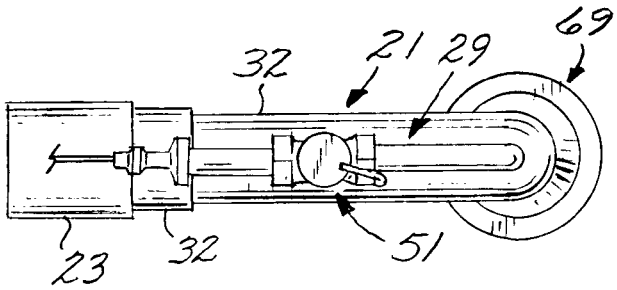
FIG. 2 is a top plan view thereof.
Figure 3:
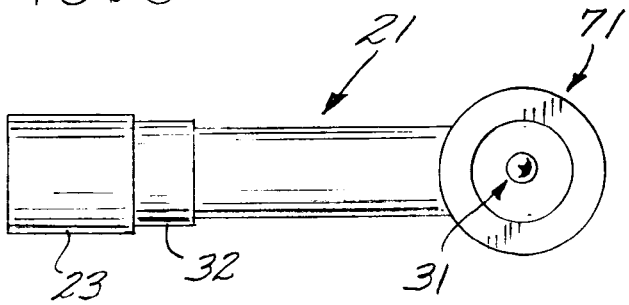
FIG. 3 is a bottom plan view thereof.
Figure 4:
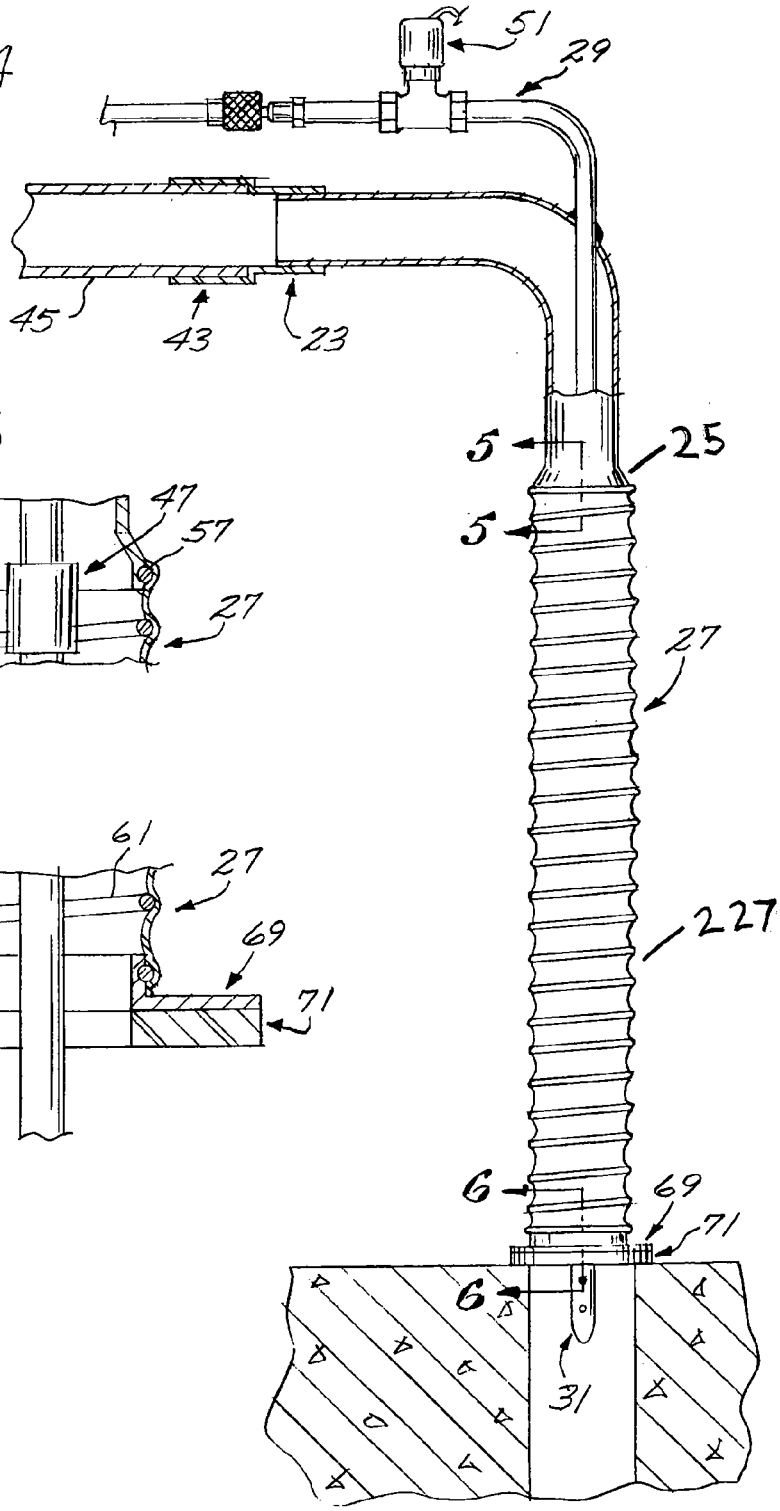
FIG. 4 is a view, similar to FIG. 1 but partially broken away and depicting the device positioned for cleaning a masonry bore.
Figures 7, 8:
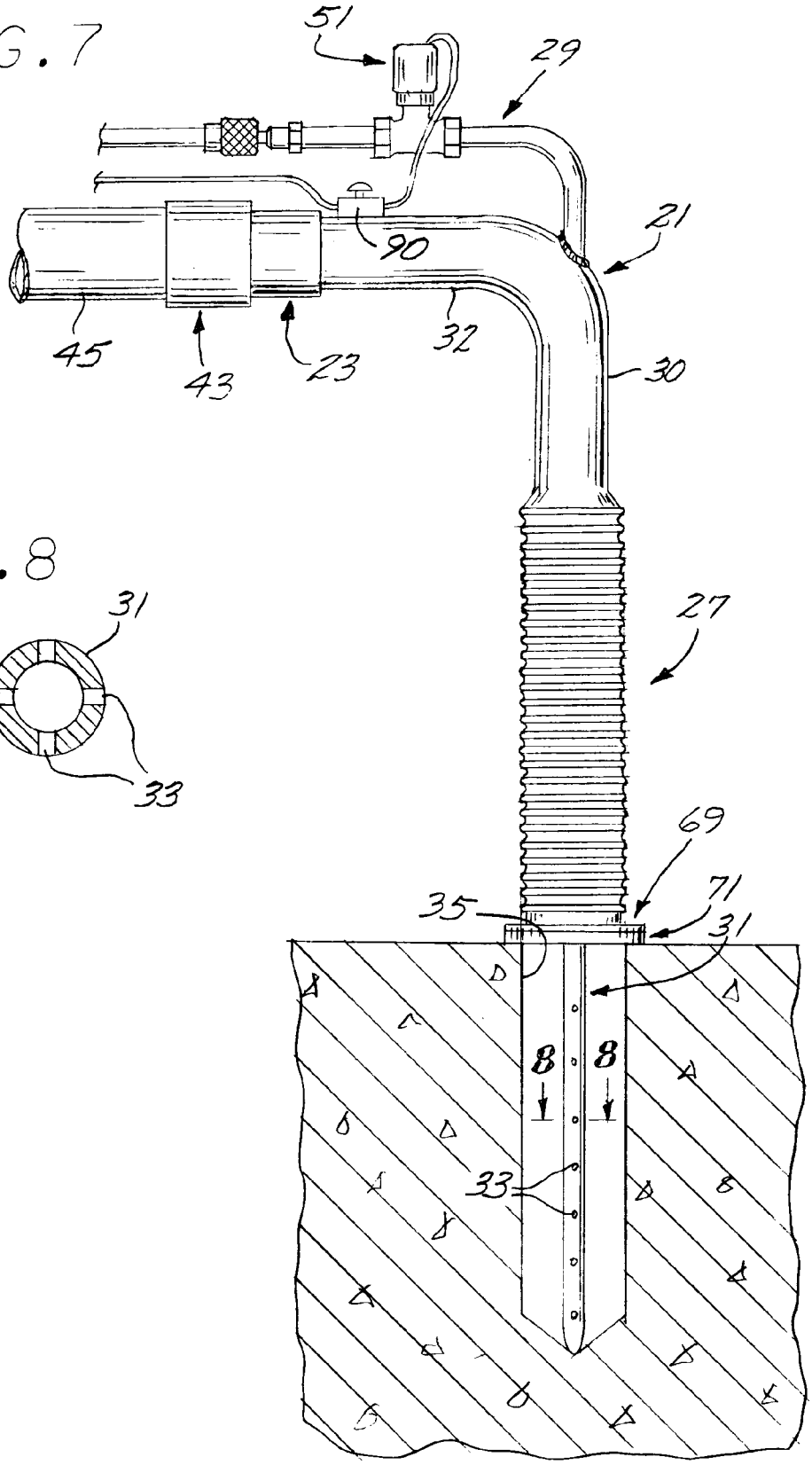
FIG. 7 is a front view similar to FIG. 4 but depicting a pressure tube projecting through the masonry bore.
FIG. 8 is a transverse sectional view, in enlarged scale, taken along the line 8-8 of FIG. 7.

Referring to FIGS. 1 and 4, the bore cleaning device of the present invention includes, generally, a fitting 21 which may be elbow shaped and is constructed at one end with a vacuum coupling 23 and on the opposite end with a tube connector 25 for connecting with one end of a contractible cover tube 27. Connected with the fitting 21 is a pressure line, generally designated 29, which joins interiorly with one end of a pressure tube 31 configured in its distal side wall with orifices 33 for release of high pressure air in a masonry bore 35 (FIG. 4). Thus, the vacuum coupling 23 may be coupled with a vacuum pump, the pressure line 29 with a compressor and the tube 27 abutted at its distal end over the bore 35 as shown in FIG. 4 and compressed to project the pressure tube 31 into the bore as shown in FIG. 7 to elevate the pressure in such bore while a vacuum is drawn to cooperate in drawing dust and debris from such bore and upwardly through the fitting and to a filtration system coupled with a vacuum pump.

In the preferred embodiment, the fitting 21 is constructed of 2½ inch rigid wall stainless steel and is formed at the one extremity with the slip fit vacuum coupling 23 which receives a friction fit skirt 41 of a collar, generally designated 43, connected with the end of a vacuum hose 45 (FIG. 4).

Figure 5:
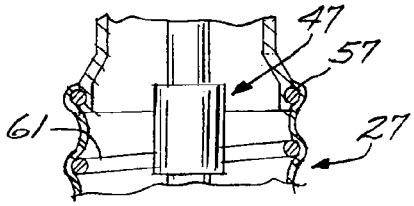
FIGS. 5 and 6 are partial vertical sectional views, in enlarged scale, taken along the lines 5-5 and 6-6, respectively.
Figure 6:
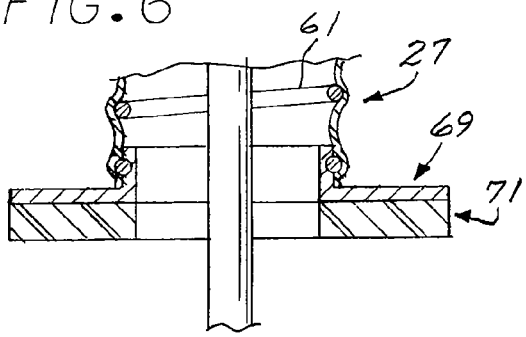

The preferred embodiment, the vacuum line 29 may also be constructed of stainless steel and is configured to pass through the wall of the fitting 23 as shown in FIG. 4 to be formed on its lower extremity with an internally threaded collar 47 for threadable receipt of the externally threaded proximal extremity of the pressure tube 31 (FIG. 5).

In one preferred embodiment, the pressure line 29 includes a control valve, depicted for illustrative purposes as a solenoid valve, generally designated 51, and which may, in some embodiments, be connected in an electrical circuit with the control for the vacuum pump (not shown) and with a control panel 90 so that the vacuum and pressure valves are controlled simultaneously. In some embodiments I substitute a manual valve for the solenoid valve.

The lower extremity of the fitting 21 is expanded outwardly to form a bell collar 57 (FIG. 5) configured in its periphery with an annular outwardly opening groove-receiving a connector ring 59 which serves to connect the upper extremity of the cover tube 27 with such fitting.

The tube 27 may be constructed with a flexible wall and in the preferred embodiment incorporates a coil spring 61 disposed therein in spiral fashion to be received in bellows formed by a spiral shaped convolution 65 in the wall of such tube to thereby give the tube some body and provide for a memory which tends to maintain the tube disposed in a linear axial position and which will, without undue force allow the tube to be compressed a distance sufficient to allow the distal extremity of the pressure tub 31 to be projected nearly to the blind end of the bore 35 as shown in FIG. 7.

In the preferred embodiment, the extremity of the free tube 27 includes an annular flange, generally designated 69, which mounts on the distal side thereof an annular compressible seal 71 for mating in sealing engagement with the surface in which the bore 35 is formed.

Conveniently, a workman may grasp the transverse hand hold run 32 and compress the tube 27 axially to contract the bellows therein thus projecting the pressure tube 31 distally into the bore 35 to the position shown in FIG. 7 so that the orifices 33 will be spaced along the axial length of the bore and extending adjacent the blind end of such bore so that upon actuation of the solenoid valve 51 to pressurize the tube, high pressure and high speed air will be forced from the tube to generate a high pressure turbulent flow at the blind end of such bore to thereby carry debris and dust within such bore upwardly in the air flow so that the debris is maintained airborne as the vacuum pump draws a vacuum in the vacuum tube 45 to thereby enhance the pressure differential along the length of the cover tube 27 to thus facilitate air flow through such tube and out the fitting 21 into the vacuum tube 45 to be carried to a filtration system (not shown) for filtering thereof. In practice, it has been my experience that the device of the present invention will clean a conventional masonry bore in just a minute or so, thus providing efficient and effective evacuation of dust and debris, holding it captive in the air flow stream as the conveying flow stream progresses from the bore 35 upwardly through the cover tube 27 through the fitting 21 and into the vacuum tube. This then helps maintain the atmosphere free of the dust and debris, to provide a healthy and safe work environment. In some applications, the controls for the vacuum pump and for the solenoid valve 51 are connected to a control panel 90 which will allow the operator to operate both the pump and valve simultaneously.

As will be appreciated from the foregoing, the bore cleaning device of the present invention provides an economical and convenient means for efficient and rapid cleaning of a masonry bore while protecting the workman from the dust and particles being evacuated thereby produce a clean and healthy working environment.

I claim:

1. A debris cleaning device for cleaning a deep blind bore formed through a surface and comprising:

a tubular fitting formed with first and second extremities;

a vacuum hose coupler on the first extremity;

a pressure line including a pressure hose connector and configured to project into the fitting;

an elongated pressure tube connected on one end with the pressure line and projecting a predetermined distance from the second extremity to terminate in a distal extremity including at least one pressure outlet;

an elongated dust cover connected on one end with the second extremity and projecting over the pressure tube and formed with a free extremity to contact the surface, the cover being collapsible longitudinally from a selected length to selectively extend the distal extremity from the free extremity to project into the bore.

2. The debris cleaning device as set forth in claim 1 wherein:

the fitting is constructed of a rigid tube.

3. The debris cleaning device of claim 1 wherein:

the pressure line includes a valve.

4. The debris cleaning device of claim 1 wherein:

the pressure line includes an electric valve.

5. The debris cleaning device of claim 1 wherein:

the fitting is in the shape of a 90° elbow.

6. The debris cleaning device of claim 1 wherein:

the dust cover is in the form of a hose.

7. The debris cleaning device of claim 1 wherein:

the dust cover is in the form of a bellows tube and includes biasing means to bias the tube to the selected length.

8. The debris cleaning device of claim 1 that includes:

a comprehensible seal mounted to the free extremity.

9. The debris cleaning device of claim 1 wherein:

the pressure tube is formed with a distal extremity configured with a series of laterally outwardly opening orifices.

10. The debris cleaning device of claim 1 wherein:

the pressure tube is constructed of stainless steel.

11. The debris cleaning device of claim 1 that includes:

an internally threaded boss in the pressure line for connection with the pressure tube.

12. A masonry bore cleaning device for cleaning a bore extending into a surface comprising:

a fitting including a rigid tubular elbow formed with a longitudinal run and a transverse run, the transverse run including a vacuum connector and the longitudinal run including a tube connector;

a pressure line formed on one end with a nipple and projecting through the wall of the fitting to form a threaded coupling;

a valve in the pressure line;

an elongated cover tube connected on one end with the tube connector and projecting distally therefrom to terminate in a free extremity, the cover tube being longitudinally collapsible from an extended to a retracted position;

a spring in the cover tube biasing the tube to the extended position;

a pliable seal connected to the free extremity of the cover tube;

an elongated pressure tube connected on one end with the threaded coupling and projecting therefrom to project through the cover tube and beyond the free extremity and to form a distal extremity, the distal extremity being formed with a plurality of longitudinally spaced orifices whereby the transverse run may be grasped by a workman and the seal pressed against the surface and the cover tube compressed longitudinally to cause the distal extremity of the pressure tube to project into the bore so that an air compressor may be connected with the pressure line and a vacuum pump connected with the vacuum coupler and pressurized air introduced through the tube to the orifices and a vacuum drawn in the fitting to cooperate in lifting debris from the bore and through the fitting.

13. The cleaning device of claim 12 wherein:

the fitting is constructed of stainless steel.

14. The cleaning device of claim 12 wherein:

the pressure tube is formed with at least eight orifices spaced along the length thereof.

* * * * *